US005640084A

United States Patent [19]

Tero et al.

[11] Patent Number: 5,640,084

[45] Date of Patent: Jun. 17, 1997

[54] INTEGRATED SWITCH FOR SELECTING A FIXED AND AN ADJUSTABLE VOLTAGE REFERENCE AT A LOW SUPPLY VOLTAGE

[75] Inventors: John P. Tero, Saratoga; Ali Tasdighi, San Jose, both of Calif.

[73] Assignee: TelCom Semiconductor, Inc., Mountain View, Calif.

[21] Appl. No.: 678,013

[22] Filed: Jul. 10, 1996

[51] Int. Cl.[6] ..... G05F 3/16

[52] U.S. Cl. ..... 323/313

[58] Field of Search ..... 323/315–317, 323/281, 353, 354, 313; 363/73; 327/334, 362, 350

[56] References Cited

U.S. PATENT DOCUMENTS

| | | | |
|---|---|---|---|
| 4,675,594 | 6/1987 | Renke | 323/317 |
| 4,868,482 | 9/1989 | O'Shaughnessy et al. | 323/313 |
| 4,958,123 | 9/1990 | Hughes | 323/316 |
| 5,352,972 | 10/1994 | Pernici et al. | 323/313 |
| 5,471,132 | 11/1995 | Ryut | 323/315 |
| 5,563,504 | 10/1996 | Culbert et al. | 323/316 |

*Primary Examiner*—Aditya Krishnan

*Attorney, Agent, or Firm*—Skjerven, Morrill, MacPherson, Franklin & Friel; Edward C. Kwok

[57] ABSTRACT

A fixed and a user adjustable voltage reference is alternatively provided by an integrated switch which switches between two current sources according to an input voltage. A fixed reference voltage is achieved by amplifying the current of one of the two current sources according to a predetermined voltage difference between the output terminal and an internal reference voltage. An adjustable reference voltage is achieved by amplifying the current of other of the two current sources according to a voltage difference between the internal reference voltage and an user adjustable voltage. In one embodiment, the user adjustable voltage is achieved by a user adjustable voltage divider circuit.

9 Claims, 2 Drawing Sheets

INTEGRATED SWITCH FOR SELECTING A FIXED AND AN ADJUSTABLE VOLTAGE REFERENCE AT A LOW SUPPLY VOLTAGE

BACKGROUND OF THE INVENTION

1. Field of the Invention

The present invention relates to integrated circuit designs. In particular, the present invention relates to the design of an integrated circuit which reliably provides an output voltage from a low power supply voltage.

2. Background of the Invention

In a battery-powered device, it is often necessary to operate at a low supply voltage, e.g. when the charge in the battery is running low. Thus, it is desirable to be able to provide reliably a reference voltage at low supply voltage conditions.

SUMMARY OF THE INVENTION

The present invention provides a circuit which generates both a fixed reference voltage and a user adjustable reference voltage. A circuit according to the present invention includes (a) two current source circuit, which are alternatively enabled to provide either a first current or a second current; (b) two input stages, coupled respectively to receive the first and the second current, the first input stage receiving a user adjustable input voltage and the second input stage receiving a fixed reference voltage (e.g. a bandgap voltage), each input stage providing as output a differential current; (c) a current amplifier coupled to receive from the input stages their differential currents, the current amplifier providing at an output terminal an output signal representative of the differential currents received; and (d) an input circuit which receives the input voltage to selectively enable one of the two current sources. The output signal is either a fixed reference voltage, when the second input stage is active, or a user adjustable voltage, when the first input stage is active.

In one embodiment, an internal voltage divider circuit is provided to couple between the output terminal and a supply voltage, such as the ground voltage. The voltage divider provides a feedback voltage to the second input stage. In that configuration, the differential current of that second input stage reflects the voltage difference between the feedback voltage and the reference voltage. A similar voltage divider can be provided externally to provide a similar feedback voltage to the first input stage, such that the differential current of that input stage represents the voltage difference between the feedback voltage and the reference voltage. The user can adjust the output voltage by appropriately selecting the values of the resistors of this second voltage divider.

According to another aspect of the present invention, each of the current source circuits include a current source and a switch circuit. In that configuration, each of the switch circuits, in response to the enable signal, couples its associated current source to the associated input stage. In addition, each current source includes a first transistor coupled between a supply voltage and the input stage, such that the current of the current source is provided by imposing a first bias voltage at a gate terminal of the first transistor. In that embodiment, such a bias voltage is created by coupling a second bias voltage through a second transistor controlled by the enable signal. In that arrangement, the current source is disabled when the second transistor is non-conducting. One advantage of that embodiment is that the current source can be operational down to a supply voltage equal to the sum of the gate-to-source voltages ($V_{GS}$'s) of the first and second transistors.

According to another aspect of the present invention, a comparator circuit compares the input voltage to a "threshold" reference voltage. In that embodiment, selection of which of the two current sources to enable is achieved according to whether or not the voltage of the input voltage exceeds the threshold reference voltage.

The present invention is better understood upon consideration of the detailed description below and the accompanying drawings.

DETAILED DESCRIPTION OF THE PREFERRED EMBODIMENTS

The present invention provides an integrated circuit in which an input stage selectively couples one of two current sources to a current amplifier, so as to provide either a fixed reference voltage or an adjustable voltage reference, even at low supply voltage conditions.

Figure 1:
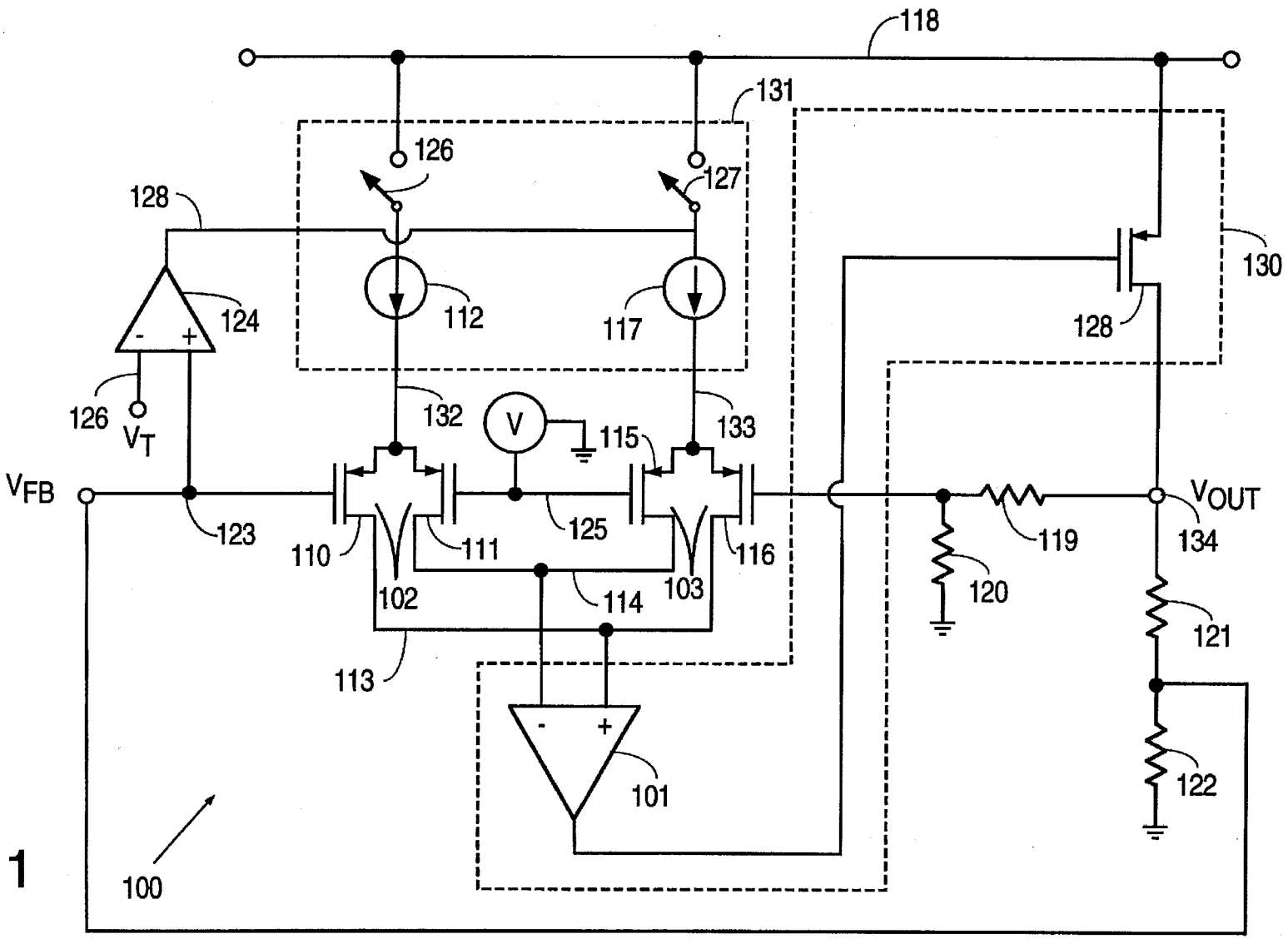
FIG. 1 shows an integrated circuit 100 having an output voltage $V_{out}$ provided by a current amplifier 101, in accordance with the present invention.

One embodiment of the present invention is shown in FIG. 1. In FIG. 1, an integrated circuit 100 provides an ouput voltage $V_{out}$, using a current amplifier 101. As shown in FIG. 1, a current amplifier 101, receives an input differential current from either one of two input stages 102 and 103. Stage 102 includes PMOS transistors 110 and 111, which are connected in common at their source terminals (terminal 132) to a current source 112. The drain terminals of transistors 102 and 103 are coupled to the negative terminal 113 and the positive terminal 114 of an amplifier 100, respectively. Similarly, stage 103 includes PMOS transistors 115 and 116, which are connected in common at their source terminals (terminal 133) to current source 117. The drain terminals of PMOS transistors 115 and 116 are coupled to negative terminal 113 and positive terminal 114 of current amplifier 101, respectively. The gate terminals of PMOS transistors 111 and 115 are both commonly coupled to a reference voltage $V_{BG}$ at terminal 125. Reference voltage $V_{BG}$ can be any reference voltage, such as a bandgap reference voltage, for example.

The output voltage of amplifier 101 is coupled to the gate terminal of PMOS transistor 128. The source terminal of PMOS transistor 128 is coupled to the positive supply voltage 118 and the drain terminal of PMOS transistor 128 is connected to an output terminal 134, which is coupled to ground voltage by a voltage divider formed by series resistors 119 and 120. In this embodiment, as explained below, a second voltage divider, formed by series resistors 121 and 122, can be provided externally (i.e. outside of integrated circuit 100). Thus, the voltage $V_{out}$ at terminal 134 is provided by the product of the current in PMOS transistor 128 and the sum of the resistive values of either resistors 119 and 120, or resistors 121 and 122, when present. Accordingly, since the current in PMOS transistor 128 depends upon the difference in the currents at negative terminal 113 and positive terminal 114 of current amplifier 101, current amplifier 101 and PMOS transistor 128 form a current amplifier 130. The common terminal of resistors 119 and 120 controls the gate terminal of PMOS transistor 116, and the common terminal of resistors 121 and 122 feeds back to input terminal 123.

In this embodiment, the voltage $V_{FB}$ at input terminal 123 is used to selectively activate either current source 112 or current source 117 via a comparator 124. Switches 126 and 127 are closed by the output voltage of comparator 124 at terminal 128, according the relative magnitudes of comparator 124's input voltage $V_{FB}$, at terminal 123, and the threshold voltage $V_T$, at terminal 126. When switch 126 is closed, current source 112 is active; otherwise, i.e. switch 127 is closed, current source 117 is active.

The voltage $V_{FB}$ at terminal 123 can be provided either externally or by feedback from the external resistors 121 and 122. Thus, when the voltage at terminal 123 is higher than the threshold voltage $V_T$, e.g. 200 mV, a user adjustable reference voltage can be achieved at terminal 134. This user adjustable reference voltage (i.e. $V_{out}$) at terminal 134 is determined by either $V_{FB}$ or the relative values of resistors 121 and 122, when present. If the voltage $V_{FB}$ at terminal 123 falls below voltage $V_T$, the fixed predetermined voltage $V_{BG}$ takes over to provide a fixed output voltage $V_{out}$ at terminal 134, according to the relative values of internal resistors 119 and 120.

In the present embodiment, PMOS transistors 110 and 111 are substantially identically sized transistors. Similarly, PMOS transistors 115 and 116 are also substantially identically sized. Thus, when current source 112 is active, the voltage difference between voltage $V_{FB}$ at terminal 123 and voltage $V_{BG}$ at terminal 125, i.e. the differential voltage, $\Delta V_{GS}$, across the gate terminals of PMOS transistors 110 and 111, results in a differential drain current in PMOS transistors 110 and 111. This differential drain current is given by:

$$I_d=\sqrt{\frac{I_1 K w}{l}}\ *\Delta V_{GS}$$

where $I_1$ is the current of current source 112, and K, w and 1 are, respectively, the transconductance parameter, the width and the length of each of PMOS transistors 110 and 111.

A similar expression governs the differential drain current between PMOS transistors 115 and 116, resulting from an input differential voltage applied across the gate terminals of PMOS transistors 115 and 116. The differential drain current in PMOS transistors 110 and 111 or PMOS transistors 115 and 116 is summed at the input terminals of current amplifier 130.

As described above, when the voltage $V_{FB}$ at terminal 123 is lower than the threshold voltage $V_T$ at terminal 126, current source 117 is active and current source 112 is inactive. Consequently, current source 117, PMOS transistors 115, 116 and 128, amplifier 101, and resistors 119 and 120 form a feedback circuit, which provides an output voltage $V_{out}$ at terminal 134 given by:

$$V_{out}=\frac{V_{BG}(R_1+R_2)}{R_2}$$

where $R_1$ and $R_2$ are the values of resistors 119 and 120 respectively.

Likewise, when voltage $V_{FB}$ at terminal 123 is higher than threshold voltage $V_T$ at terminal 126, current source 112 is active and current source 117 is inactive. Consequently, current source 112, PMOS transistors 110, 111 and 128, amplifier 101, and resistors 121 and 122 form a feedback circuit, which provides an output voltage $V_{out}$ at terminal 134 given by:

$$V_{out}=\frac{V_{BG}(R_3+R_4)}{R_4}$$

where $R_3$ and $R_4$ are the values of resistors 232 and 122 respectively.

Figure 2:
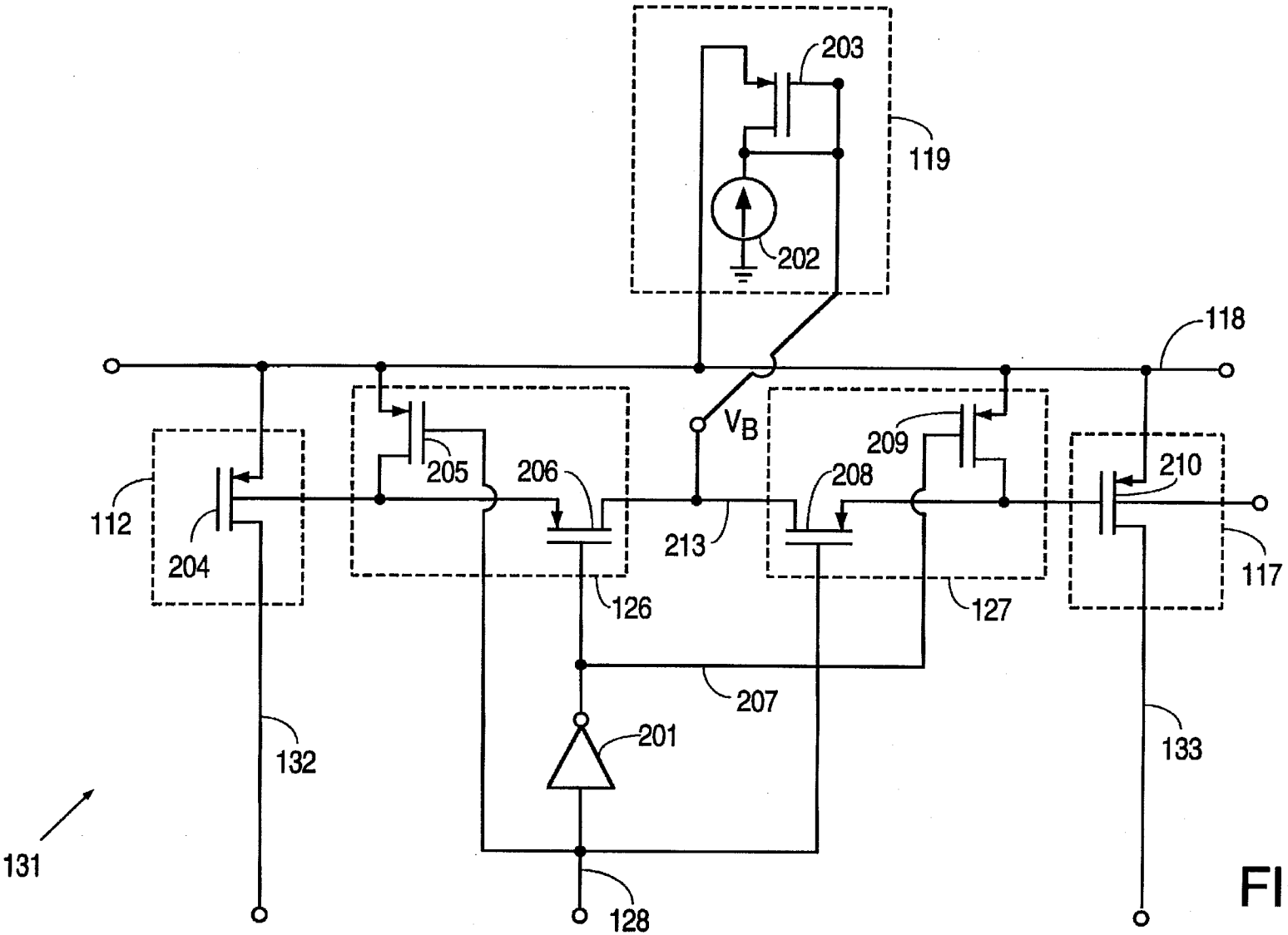
FIG. 2 shows a control circuit 131 of integrated circuit 100, which is functional down to a supply voltage as low as $2*V_{GS}$ of a transistor under saturation.

Current sources 112 and 117 and switches 126 and 127 form a control circuit 131, in accordance with the present invention, which is operational down to a supply voltage as low as $2*V_{GS}$ (i.e. twice the gate-to-source voltage) of a transistor operating in the saturation region. One implementation of control circuit 131 is illustrated in FIG. 2. To simplify this description, like numerals are used in FIGS. 1 and 2 for like elements. As shown in FIG. 2, control circuit 131 includes current sources 112 and 117, switches 126 and 127, current source 119 and inverter 201. A control signal for controlling switches 126 and 127 is provided at terminal 128. Output currents are provided at terminals 132 and 133 which, as shown in FIG. 1, are coupled to input stages 102 and 103. In current source 119, a current source 202 is coupled to supply voltage at terminal 118 through a PMOS transistor 203. The voltage at the gate terminal of PMOS transistor 203 provides a bias voltage $V_B$.

Current source 112 is activated by the control signal at terminal 128 through switch 126. Switch 126 includes PMOS transistors 205 and 206. Similarly, current source 117 is activated by the control signal at terminal 128 through switch 127, which includes PMOS transistors 208 and 209. When the control signal at terminal 128 is at logic high, the output terminal of inverter 201 is at logic low, so that PMOS transistor 206 is conducting and PMOS transistor 205 is non-conducting. Consequently, the bias voltage $V_B$ at terminal 213 is coupled to gate terminal of PMOS transistor 204. The current in PMOS transistor 203 is then mirrored to PMOS transistor 204, thereby allowing the output current source 112 to flow in terminal 132. At the same time, PMOS transistor 208 is rendered non-conducting and PMOS transistor 209 is rendered conducting. Thus, the supply voltage at terminal 118 is coupled to the gate terminal of PMOS transistor 210, turning off PMOS transistor 210, thereby preventing the output current of current source 117 to flow in terminal 133. Conversely, if the control signal at terminal 128 is at logic low, current source 112 is deactivated and current source 117 is activated, and a current flows at output terminal 133.

As seen in FIG. 2, current source 112 is active if the voltage $V_{on}$ at the gate terminal of PMOS transistor 204 is at least one $V_{GS}$ below the supply voltage at terminal 118. When current source 112 is active, PMOS transistor 206 is conducting, so that its gate voltage $V_G$ is at least one $V_{GS}$ below voltage $V_{on}$:

$$V_G=V_{on}+V_{GS}$$

Thus, for PMOS transistors 204 and 206 to be both conducting, the supply voltage at terminal 118 must not fall below the sum of the gate-to-source voltages (i.e. $V_{GS}$'s) of PMOS transistors 204 and 206. Thus, control circuit 131 is active down to a supply voltage of $2*V_{GS}$'s (e.g. 1.6–1.8 volts). A similar analysis can be performed with respect to current source 117 and switch 127.

The advantage of providing a reference voltage using the current source switching scheme of FIGS. 1 and 2 is that it can be achieved down to supply voltages of $2*V_{GS}$'s, while maintaining a low on-resistance for the switches, at the cost of two sets of current sources (i.e. current sources 112 and 117), two set of switches (i.e. switches 126 and 127) and two input stages (i.e. input stages 102 and 103) to drive the current amplifier 130. An error voltage may be created at output terminal 134 due to the different input offset voltages between input stages 102 and 103. However, for low voltage applications where $V_{out}$ is only a small multiple of the reference voltage $V_{BG}$, such an error is negligible.

The above detailed description is provided to illustrate the specific embodiments of the present invention and is not intended to be limiting. Numerous variations and modification within the scope of the present invention are possible. For example, while the above embodiments use PMOS transistors for the input stages, the current sources and the switches, NMOS transistors can also be used. For example, current sources can be coupled by NMOS devices to the negative supply voltage. Alternatively, bipolar devices can also be used in place of the MOS devices described above. The present invention is defined by the claims appended hereinbelow.

We claim:

1. A circuit for providing a reference voltage, comprising:

a first current source circuit receiving an enable signal, said first current source circuit providing a first current when said first enable signal is in an active state;

a second current source circuit receiving said enable signal, said second current source circuit providing a second current when said enable signal is in an inactive state;

a first input stage, operatively coupled to said first current source circuit, said first input stage receiving a first differential voltage and said first current, and providing a first differential current representative of said first differential voltage, said first differential voltage being derived from an input voltage;

a second input stage, operatively coupled to said second current source circuit, said second input stage receiving a second differential voltage and said second current, and providing a second differential current representative of said second differential voltage, said second differential voltage being derived from a reference voltage;

a current amplifier, operatively coupled to said first and second input stages to receive said first and second differential currents, said current amplifier providing at an output terminal an output signal representative of said first and second differential currents received; and an input circuit for receiving said input voltage and providing said active and inactive states of said enable signal in accordance with said input voltage.

2. A circuit as in claim 1, further comprising a voltage divider circuit coupled between said output terminal and a supply voltage to provide a feedback voltage to said second input stage, said second differential voltage being representative of the voltage difference between said feedback voltage and said reference voltage.

3. A circuit as in claim 1, further comprising a voltage divider circuit coupled to said output terminal to provide said input signal at said first input stage, said first differential voltage being representative of the voltage difference between said input voltage and said reference voltage.

4. A circuit as in claim 1, wherein said first current source circuit comprises a current source and a switch circuit, said switch circuit being responsive to said enable signal to couple said current source to said first input stage.

5. A circuit as in claim 4, wherein said current source comprises a first transistor coupled between a supply voltage and said first input stage, said first current being provided in said first transistor by imposing a first bias voltage at a gate terminal of said first transistor, said first bias voltage being provided by coupling a second bias voltage through a second transistor, said second transistor being controlled by said enable signal.

6. A circuit as in claim 1, wherein said second current source circuit comprises a current source and a switch circuit, said switch circuit being responsive to said enable signal to couple said current source to said second input stage.

7. A circuit as in claim 6, wherein said current source comprises a first transistor coupled between a supply voltage and said second input stage, said first current being provided in said first transistor by imposing a first bias voltage at a gate terminal of said first transistor, said first bias voltage being provided by coupling a second bias voltage through a second transistor, said second transistor being controlled by said enable signal.

8. A circuit as in claim 1, wherein said input circuit further comprises a comparator circuit receiving said input voltage and a second reference voltage, said input circuit providing said enable signal in said active state, when the voltage of said input voltage exceeds said second reference voltage.

9. A circuit as in claim 1, wherein said reference voltage is derived from a bandgap voltage.

* * * * *